US006178910B1

(12) United States Patent
Pollack

(10) Patent No.: US 6,178,910 B1
(45) Date of Patent: Jan. 30, 2001

(54) SWIVEL DRIVE ARRANGEMENT

(75) Inventor: Jack Pollack, Monaco (MC)

(73) Assignee: Single Buoy Moorings, Inc., Marly (CH)

( * ) Notice: Under 35 U.S.C. 154(b), the term of this patent shall be extended for 0 days.

(21) Appl. No.: 09/355,625

(22) Filed: Sep. 20, 1999

(30) Foreign Application Priority Data

Dec. 2, 1997 (EP) ..... 97202776

(51) Int. Cl.[7] ..... B63B 21/00
(52) U.S. Cl. ..... 114/230.12; 114/293
(58) Field of Search ..... 114/230.12, 293, 114/230.13, 230.14; 441/3–5; 141/387, 388

(56) References Cited

U.S. PATENT DOCUMENTS 5,823,837 * 10/1998 Boatman et al. ..... 441/5

* cited by examiner

*Primary Examiner*—Ed Swinehart
(74) *Attorney, Agent, or Firm*—Young & Thompson

(57) ABSTRACT

The vessel including a hull and a cylindrical turret well, with a weathervane around a geostationary turret located in the turret well, and at least one swivel supported on the turret. The inner wall of the swivel is connected to rotation drive which allows the fall swivel weight to be transferred directly to the turret. The inner wall of at least one swivel is rotatably connected to a swivel support structure on the turret via a bearing. The rotation drive is adapted for rotating the inner walls in conjunction with the vessel so that relative displacements between the swivel and the turret are reduced such that the layout of the pipe lines connected to the swivel can be simplified by the omission of expansion loops. As the weight of the swivel is carried by the turret, the rotation and pipe support structure can be relatively small. The outer walls of the swivel stack may be fixedly connected to the turret so that a separate rotational drive for the outer walls can be avoided.

10 Claims, 4 Drawing Sheets

SWIVEL DRIVE ARRANGEMENT

BACKGROUND OF THE INVENTION

The invention relates to a mooring construction having at least one swivel comprising an outer and an inner annular wall defining a ring-shaped central chamber, the walls each comprising an opening which is in fluid communication with the central chamber, one of the walls being connected to a riser extending from a subsea structure to the swivel, the other of the walls being connected to a product supply duct.

DESCRIPTION OF THE RELATED ART

It is known in the offshore technology to support the inner walls of a swivel stack from a gantry, or swivel support structure. The swivel support structure can be placed on an fixed tower resting on the sea bed or can be connected to the vessel in such a way that it bridges the turret In this construction each outer wall of each swivel is supported on the inner walls of the swivel stack. In order to overcome the resistance forces between the inner and outer walls which are created by the high pressure in the central chamber and by the elastic sealing elements between the inner and outer walls, it is known to use drive mechanisms for rotating the outer walls of the swivel in the form of a rigid frame connecting the outer rings and the vessel. The known drive mechanisms are normally placed near the largest diameter swivels near the bottom of a swivel stack. The drive mechanisms have large diameters as they surround the inlet piping connected to the outer walls of the swivels and in view of fatigue problems due to continuous small excursions of the vessel around the turret.

Due to the large mass of the swivel stack, wherein each swivel may weigh up to 20 tons, and the large dimensions of the gantry and the turret, the diameter of which may amount to 20 meters, relatively large displacements between the swivel stack and the turret can occur. In order to take up variations in the spacing between the turret and the swivel, the product piping that is connected to the outer walls of the swivel stack has a relatively complex configuration and comprises a number of expansion loops. In order to accommodate the piping arrangement with the expansion loops, and in view of the large swivel weight, the swivel support structure is relatively large.

SUMMARY OF THE INVENTION

Therefore, it is an object of the present invention to provide a swivel drive arrangement which can be of small dimensions and which allows for a favourable support structure for the swivel.

It is an other object of the present invention to provide a swivel support structure which is relatively small and which allows for relatively little displacement between the swivel and the swivel support structure, in particular between the swivel and the turret. It is again an object of the present invention to provide a swivel support structure which can be used in conjunction with a straight forward configuration of the product piping.

Hereto the mooring construction according to the present invention is characterised in that the inner wall is rotatably suspended from a swivel support structure, the inner wall being further connected to rotation drive means for rotating the inner wall with respect to the support structure. By connecting the rotation drive means to the inner wall of the swivel, the drive means can be relatively small as they only have to surround the centralised piping that leaves the inner part of the swivel. The swivel support structure according to the present invention may be mounted on the turret of a vessel or may be part of a fixed tower construction resting on the seabed to which tower construction a vessel is moored in such a way that it can weathervane.

In one embodiment according to the present invention the outer wall is connected to the-riser and the inner wall is connected to the product supply duct. For this swivel arrangement the connection of the rotation drive means to the inner wall of the swivel, or multiple swivels in a swivel stack, allows the weight of the swivel to be transferred directly to the turret wherein the inner wall is rotated by the drive means to rotate in conjunction with the vessel while weathervaning around the turret.

According to another embodiment of the present invention the inner wall of at least one swivel is rotatably connected to the swivel support structure on the turret via a bearing, the rotation drive means being adapted for rotating the inner wall in conjunction with the vessel. Because the inner wall of the swivel is directly connected to the turret via the support structure, the swivel can be kept better in line with the turret. Deformations between the turret and the swivel are reduced thereby so flat it not necessary to use expansion loops in the product piping and that the pipe layout can be simplified. By means of the rotating support via the bearing, the inner wall of the swivel can be kept accurately in line with the vessel when the vessel weathervanes around the geostationary turret.

The outer wall of the swivel may be connected to the turret so that it can rotate in conjunction therewith. Preferably the rotation drive means for the outer wall are provided in the form of a motor drive. Preferably multiple swivels are used, the inner walls of which are interconnected to form a stack. The inner walls may for instance be connected by means of bolts in a weight-carrying manner whereas the outer walls of each swivel in the stack are independently supported on the inner walls.

In a further embodiment of a vessel according to the present invention the outer wall of the swivel is fixedly connected to the swivel support structure on the turret. In this way the outer wall of the swivel supports the swivel weight. No bearing between the swivel and the turret is necessary in this case. Preferably a multiplicity of swivels is used wherein the outer walls are mutually connected to form a stack. The outer walls of the swivel are for instance connected by means of bolts in a weight-bearing manner whereas the inner walls of the swivel may be interconnected by rotation transfer members to be rotationally coupled. By means of the above construction, the support structure on the vessel for the rotational drive and the product pipes can be largely reduced in size.

BRIEF DESCRIPTION OF THE DRAWINGS

The invention will be explained hereafter with reference to the accompanying drawings. In the drawings.

DESCRIPTION OF THE PREFERRED EMBODIMENTS

Figure 1:
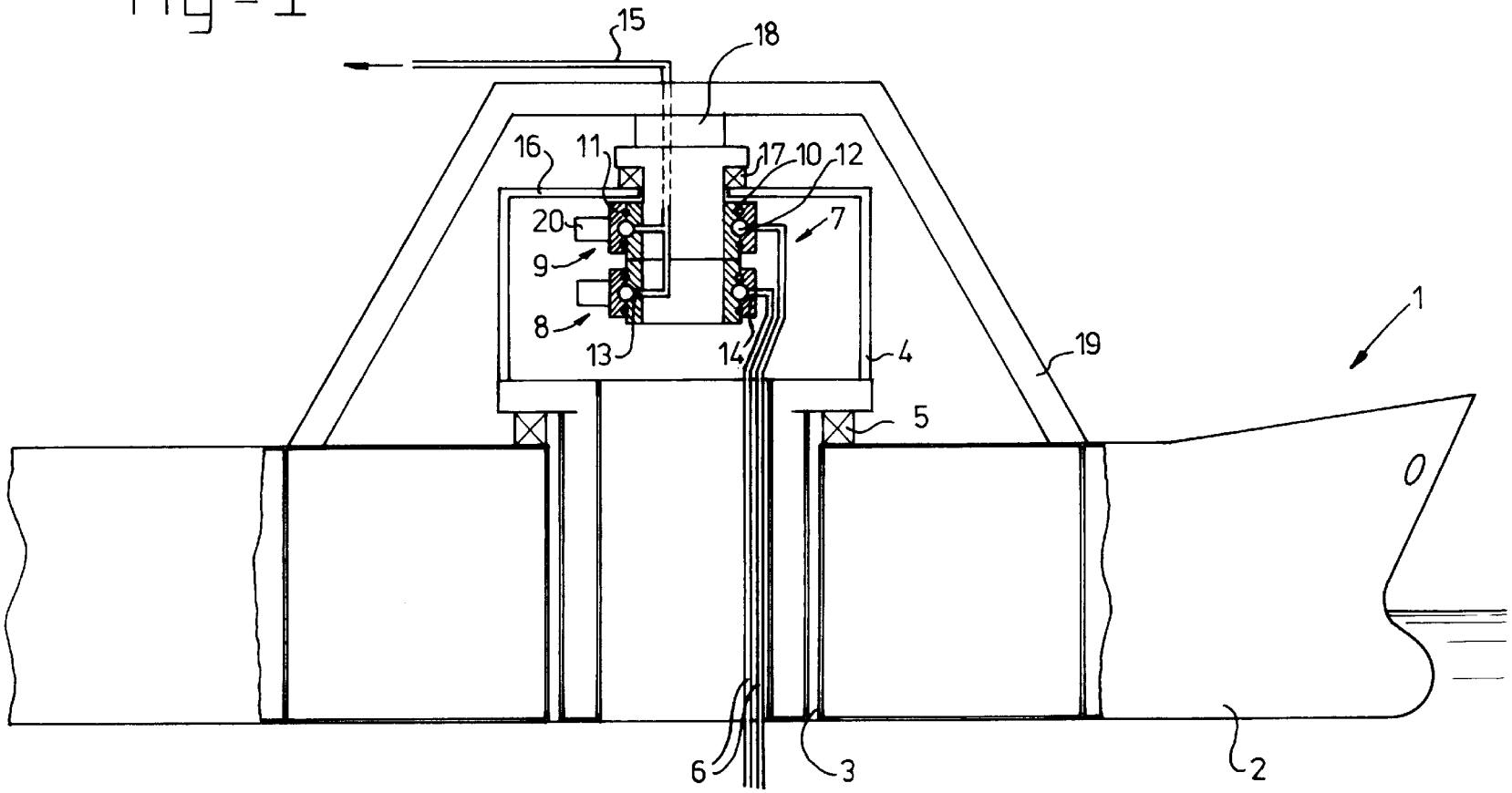
FIG. 1 shows a schematic side view of a first embodiment of the present invention wherein the inner walls of a swivel stack are rotatingly connected to a swivel support structure on the turret of a vessel.

FIG. 1 shows a vessel 1 comprising a hull 2 having a cylindrical turret well 3. A turret 4 is rotatingly supported in the turret well 3 by means of bearings 5. A product riser 6 extends from a subsea structure, such as for instance a oil or gas well, to a swivel stack 7. The swivel stack 7 comprises in this embodiment two individual swivels 8,9. Each swivel comprises an inner annular wall 10 and an outer annular wall 11. The annular walls 10,11 define a central ring-shaped chamber 12 which may be of circular, square or any other cross-sectional shape. Openings 13 and 14 extend through the inner and the outer walls 10,11 respectively and form a connection between a product riser 6 and a product pipe 15 and the central chamber 12. The swivel stack 7 is rotatably supported from a swivel support structure 16 via bearings 17. The construction, as is shown in FIG. 1 has as an advantage that the point of gravity of the swivel stack is relatively low as the swivel stack is positioned partly in the manifold room inside the turret 4. Furthermore, due to the lower position of the swivel stack 7 in a construction as shown in FIG. 1, compared to a swivel stack which is placed on top of the turret 4, deflections between different parts of the swivel stack will be less compared with higher placed swivel stacks under the same conditions.

The inner walls 10 of the swivel stack 7 are connected to a drive mechanism 18 which is supported from a pipe support structure 19. The drive mechanism 18 will rotate the inner walls of the swivel stack 7 in conjunction with the vessel 1 when the vessel weathervanes around the turret 4. The outer walls 11 of each swivel 8,9 in the swivel stack 7 are each connected to a small dive mechanism 20 for rotating the outer walls in conjunction with the turret 4. In the present embodiment the layout of the product piping near the outer rings of the swivel is relatively simple and does not include complex expansion loops. Furthermore is the construction of the pipe support 19 relatively small as it does not have to carry the full weight of the swivel stack 7 and in view of the reduced space for the product piping.

Figure 2A:
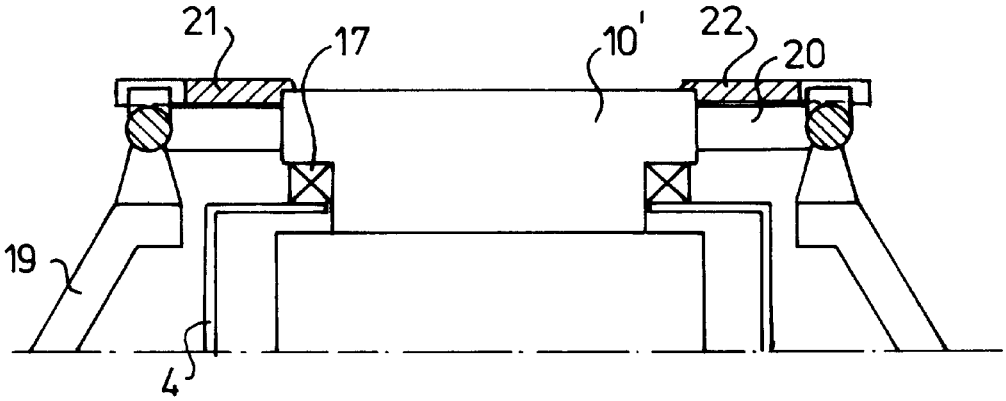
FIGS. 2*a* and 2*b* show an embodiment similar to the embodiment of FIG. 1, wherein the rotation drive means comprise a rigid frame.
Figure 2B:
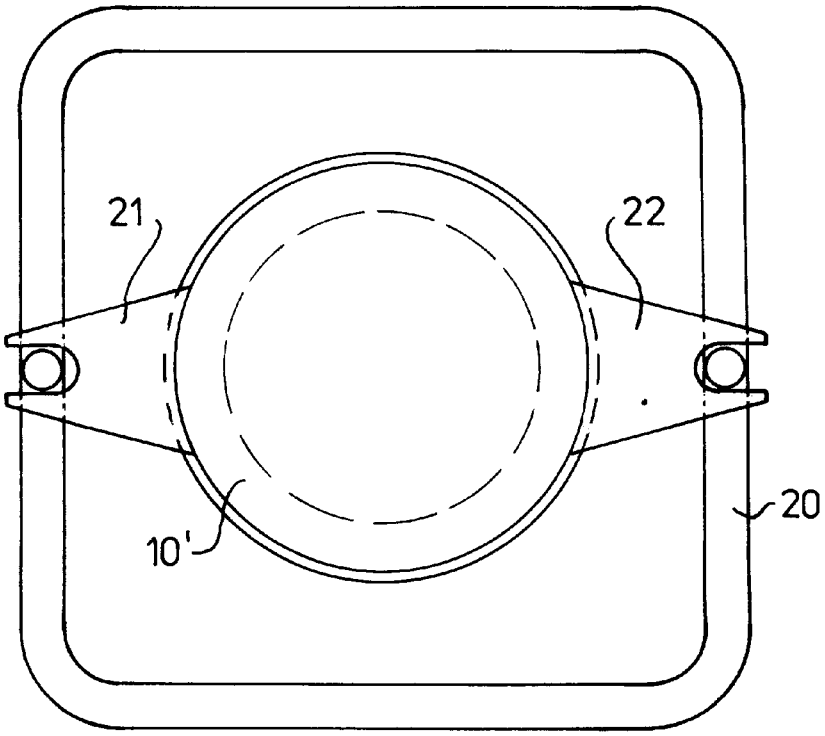

In the embodiment of FIG. 2*a* the upper part 10' of the inner walls 10 is connected to the pipe support structure 19 by means of a rigid frame 20. As can be seen in FIG. 2*b*, the upper part 10' of the swivel stack inner walls is connected to the frame 20 by means of flanges 21,22 which allow for a lateral excursion of the frame 20 with respect to the swivel stack 7. The frame 20 only exerts a torque on the inner walls 10 without transferring any radial forces to these walls. As the frame 20 only has to surround the inner product piping 15, the dimensions can be kept relatively small.

Figure 3:
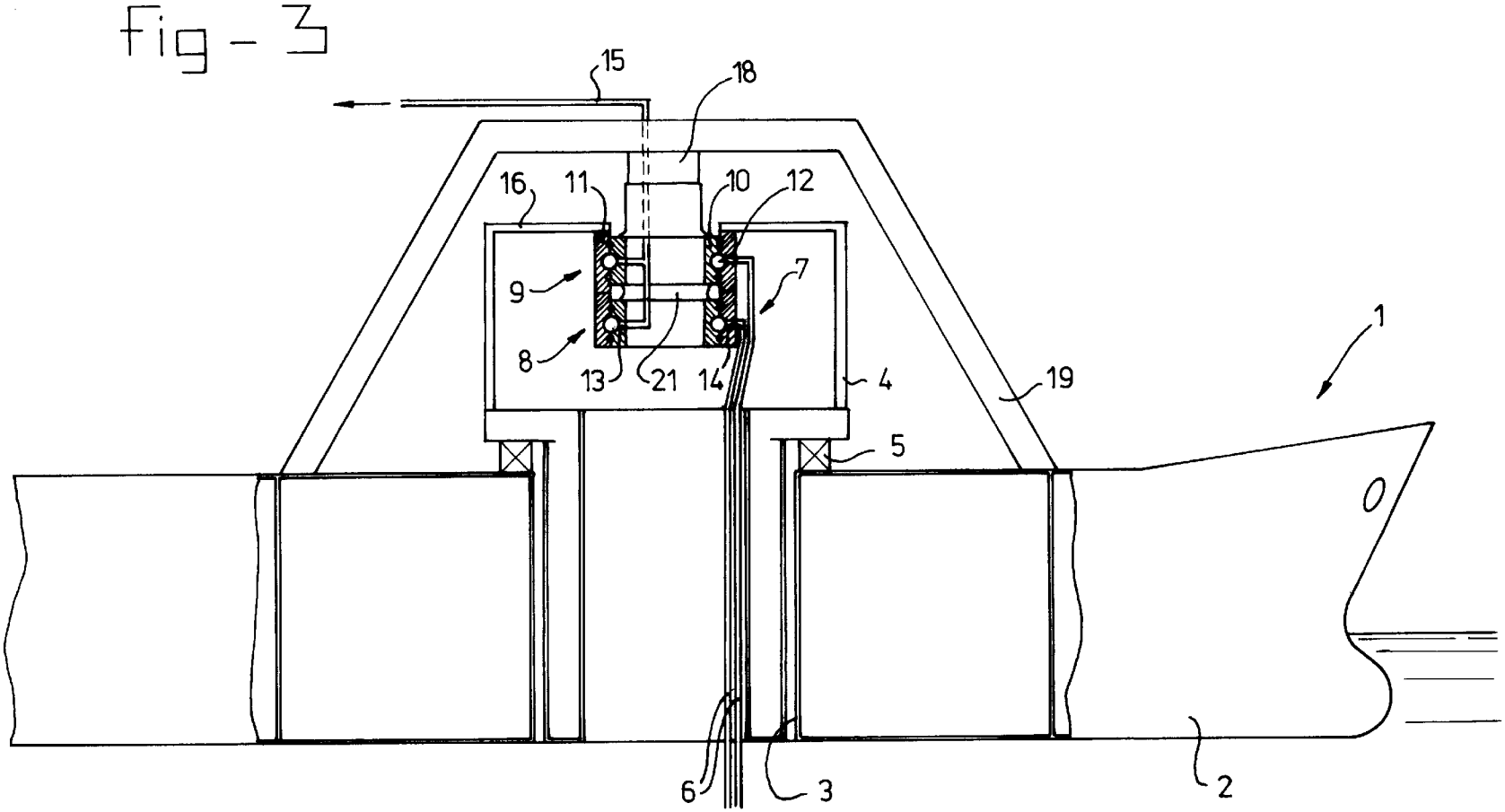
FIG. 3 shows a schematic side view of a second embodiment according to the present invention wherein the outer walls of a swivel stack are fixedly connected to a swivel support structure on the turret of a vessel.

In the embodiment of FIG. 3, the outer ring 11 of the swivel 9 is connected to the swivel support structure 16. The outer ring 11 carries the weight of the swivel 8 in the stack 7. The inner rings of the swivels 8 and 9 are interconnected by rotation transfer members 21. The rotation drive means 18, such as for instance an electric motor, is supported from the pipe support structure 19 and drives the inner rings of the swivels 8,9 in conjunction with the vessel.

Although it is shown in FIG. 3 that the swivel stack is carried by the upper part 16 of the turret 4, it is also possible to support the swivel stack, for instance by connecting the outer ring 11 of the swivel 8 to the side walls of the turret in a weight-bearing manner. Furthermore, the invention is not limited to the shown swivel arrangements wherein the riser 6 is connected to the outer walls 11 and the product piping 15 is connected to the inner walls 10, but also covers arrangements wherein the product piping 15 is connected to the outer walls 11, the riser 6 being connected to the inner walls 13, and constructions wherein the swivel stack 7 is supported on the support structure 16 rather than suspended therefrom.

Figure 4:
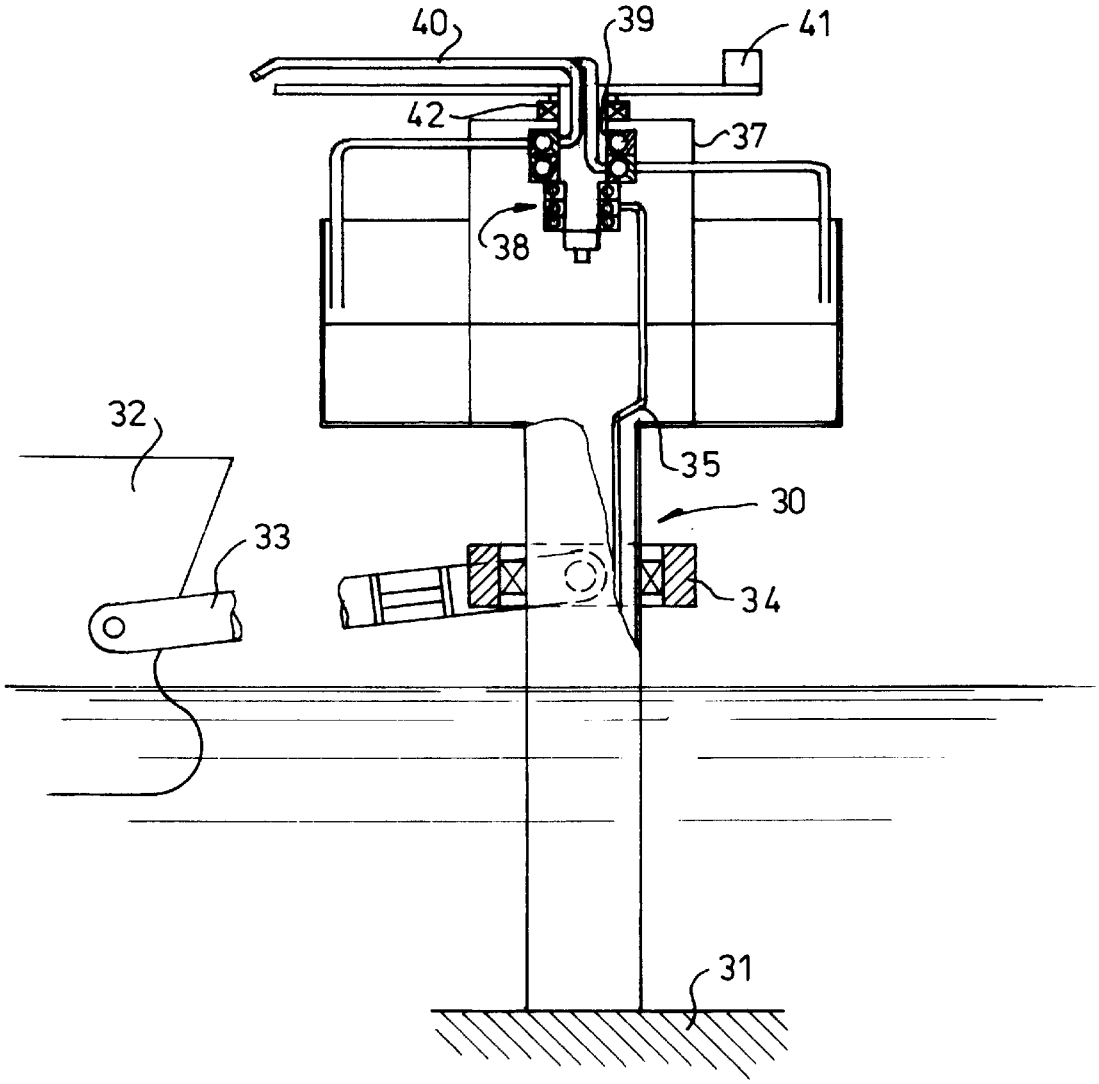
FIG. 4 shows an embodiment of a fixed tower carrying the swivel support structure.

FIG. 4 shows a second embodiment wherein the swivel stack 38 is attached to a swivel support structure 37 which forms part of a fixed tower 30. The tower comprises a column resting on the seabed 31 to which the vessel 32 is moored via a mooring arm 33. The arm 33 is hingably attached to a rotatable bearing part 33. The swivel stack 38 is suspended from a swivel support construction 37 via a bearing 42. The inner walls 39 of the swivels and the swivel stack 38 are mutually attached and can be rotated by an electrical drive motor 41. Product risers 35 extend from the seabed to the outer annular rings of each respective swivel. Product piping 40 extends from the inner annular rings of the swivels in the swivel stack 38 towards the vessel 32. Rotation of the drive motor 41 adjusts the angular position of the inner rings of each swivel to be aligned with the vessel 32 upon weathervaning of the latter.

What is claimed is:

1. Offshore mooring construction comprising at least one swivel (8,9) comprising an outer (11) and an inner (10) annular wall defining a ring-shaped central chamber (12), the walls (10,11) each comprising an opening (13,14) which is in fluid communication with the central chamber (12), one of the walls (10,11) being connected to a riser (6,35) extending from a subsea structure to the swivel (8,9), the other of the walls (10,11) being connected to a product supply duct (15,40), characterized in that the inner wall (10) is rotatably suspended from or supported by a swivel support structure (16,37), the inner wall (10) being further connected to rotation drive means (18,41) for rotating the inner wall (10) with respect to the support structure (16,37).

2. Mooring construction according to claim 1, wherein the outer wall (11) is connected to the riser (6, 35) and the inner wall (10) is connected to the product supply duct (15, 40).

3. Mooring construction according to claim 2, wherein the inner wall (10) is rotatably connected to the swivel support structure (16, 37) via a bearing (17, 42), the rotation drive means (18, 41) being adapted for rotating the inner wall (10)

in conjunction with a vessel (1, 32) that is connected to the product supply duct (15, 40) of the mooring construction.

4. Mooring construction according to claim 1, comprising a turret (4), the swivel support structure (16) being mounted on the turret (4).

5. Mooring construction according to claim 4, characterized in that, the outer wall (11) of the swivel (9) is connected to rotation drive means (20) for rotating the outer wall (11) in conjunction with the turret (4).

6. Mooring construction according to claim 4, wherein the mooring construction comprises at least two swivels (8,9), the inner walls (10) of which are mutually connected to form a stack (7).

7. Mooring construction according to claim 2, wherein the outer wall (11) is fixedly connected to the swivel support structure (16, 37), the rotation drive means (18, 41) being adapted for rotating the inner wall (10) in conjunction with a vessel (1, 32) that is connected to the product supply duct (15, 40) of the mooring construction.

8. Mooring construction according to claim 7, wherein the mooring construction comprises at least two swivels (8,9), the outer walls (11) of which are mutually connected to form a stack (7).

9. Mooring construction according to claim 1, wherein the swivel support structure (37) substantially carries the weight of the at least one swivel (8).

10. Mooring construction according to claim 1, wherein the rotation drive means (18,20, 41) comprise a motor drive.

* * * * *